US009340258B1

(12) United States Patent
Long

(10) Patent No.: US 9,340,258 B1
(45) Date of Patent: May 17, 2016

(54) STOWABLE DEPLOYMENT BEVERAGE BAR FOR BOAT SIDE USE

(71) Applicant: Keith Long, Horeseheads, NY (US)

(72) Inventor: Keith Long, Horeseheads, NY (US)

( * ) Notice: Subject to any disclaimer, the term of this patent is extended or adjusted under 35 U.S.C. 154(b) by 0 days.

(21) Appl. No.: 13/987,357

(22) Filed: Jul. 16, 2013

Related U.S. Application Data

(60) Provisional application No. 61/672,568, filed on Jul. 17, 2012.

(51) Int. Cl.
*B63B 17/00* (2006.01)
*B63B 19/04* (2006.01)
*B63B 29/00* (2006.01)

(52) U.S. Cl.
CPC ..... *B63B 17/00* (2013.01); *B63B 29/00* (2013.01)

(58) Field of Classification Search
CPC ..... B63B 17/00; B63B 29/00
USPC ..... 114/361, 363
See application file for complete search history.

(56) References Cited

U.S. PATENT DOCUMENTS

| | | | | |
|---|---|---|---|---|
| 4,799,447 | A * | 1/1989 | Hebert et al. | 144/362 |
| 5,025,747 | A * | 6/1991 | Grayson | 114/362 |
| 5,085,164 | A * | 2/1992 | Whitton | 114/362 |
| 7,900,575 | B2 * | 3/2011 | Walbridge et al. | 114/363 |
| 8,056,496 | B1 | 11/2011 | Bussa | |

* cited by examiner

*Primary Examiner* — Anthony Wiest
(74) *Attorney, Agent, or Firm* — Randall L. Reed, Esq.; Miller Mayer LLP

(57) ABSTRACT

A deployable stowable beverage bar system that can be securely but detachably connected to the side of a pleasure craft. The beverage bar having seating on which a swimmer next to the boat can sit and have access to a bar to place a drink or food on when sitting in the seating provided. The beverage bar system can be folded up next to the boat above the water line so the boat can be moved without the beverage bar system causing undue drag on the boat while moving or act as an obstruction to navigation and easily redeployed when the boat stops at a new anchorage.

19 Claims, 4 Drawing Sheets

STOWABLE DEPLOYMENT BEVERAGE BAR FOR BOAT SIDE USE

CROSS-REFERENCE TO RELATED APPLICATIONS

This application claims the benefit of priority under 35 U.S.C. §119 of U.S. Provisional Application for a Fold-up Drink Bar and Submersible Bar Stools for Boat Side Ser. No. 61/672,568 filed on Jul. 17, 2012 the content of which is relied upon and incorporated herein by reference in its entirety.

FIELD OF INVENTION

The present invention relates to an improvement to a pleasure craft, more particularly it relates to a detachable stowable bar for boat side use.

BACKGROUND OF INVENTION

During the summer months millions of pleasure crafts ply the streams and lakes of America and many other countries of the world. The pontoon boat or party barge makes up a significant portion of those pleasure crafts used. The boat can be easily moved around a lake or stream and anchored at a desirable spot for people to enjoy the water and view for a few hours or the whole day.

The floating platform provided by the pontoon boat or party barge allows one to easily get off the boat to swim and then get back on. However, when one wants to refresh themselves with a beverage if they don't get back on the boat and prefer to drink while they are in the water they encounter a number of problems. If the water's over their head they must hold onto something. Even if they can stand up in the water they do not have a convenient spot to set their drink down and there's no place to sit and relax. While a floating device designed as a floating bar may offer a solution they still have major shortcomings including they take up a significant portion of space on board the vessel when not in use or must be dragged behind the boat when moving and even when in use the individual still must restrain themselves in some fashion by either hold onto the floating device itself or holding onto the boat or alternatively treading water.

SUMMARY OF THE INVENTION

The present invention provides a deployable bar for a pontoon boat that includes: a) at least two rigid bands each band having at a first end a short flat piece that connects to an extended curved portion that has a radius of curvature of a boat floatation pontoon and length equivalent to approximately half the diameter of the boat floatation pontoon; b) flexible bands attached to a second end of each of the rigid bands, the flexible bands have a length that when added to the length of the curved portion of the rigid band is less than the diameter of the pontoon but of a sufficient length that when the flat short first ends of the at least two bands are attached to a support strut that connects a pontoon boat body to the floatation pontoon on the side of the boat a second end of the flexible bands attaches to an opposite side of the support strut to securely hold the rigid band against the pontoon; c) the at least two rigid bands have hingedly connected to them a first end of a support frame, the support frame having at least one seat at a second end such that when the rigid bands and flexible bands are secured around the pontoon to the support strut connected to the pontoon, the support frame can be moved between an open position wherein when the pontoon boat is in the water a person can sit on the at least one seat partially submerged in the water next to the pontoon boat and the support frame can be moved to a stowed position wherein the at least one seat is positioned out of the water adjacent to a side of the boat; and d) a bar top hingedly attached to the rigid bands such that it can be moved from an open position where someone sitting in the at least one seat when the support frame is in an open position can place an item on the bar top to a stowed position where it is up out of the water next to the side of the boat.

In a further aspect of the deployable bar the flexible bands are selected from a group consisting of nylon straps and stainless steel cable. Additionally it includes in another aspect flexible cushioning strips positioned between each of the at least two rigid bands and the boat floatation pontoon. In another aspect it includes a tensioning mechanism connected to each of the flexible straps the tensioning mechanism being selected from a group of a ratchet mechanism or turn buckles. In yet another aspect of the invention the support frame is positioned in the open down position by flexible bands of appropriate length that attach at a first end to the rigid bands and at a second end to the support frame. In yet another aspect of the invention the flexible bands are selected from a group of flexible straps or chains. In yet another aspect the bar top has at least one cup holder, a plurality of seats the at least two bands is a plurality of bands.

In another variation of the invention it provides a deployable stowable beverage bar for a pleasure craft that includes: a) a strapping mechanism that can be detachably but securely attached to the side of a boat; b) contact pivot points on the strapping mechanism to connect a bar top that can be pivoted between a folded stowed position against the boat to a deployed flat position above the waterline adjacent to the boat; and c) at least one seat attached to a first end of a swing arm, the second end of the swing arm being pivotally attached to the strapping mechanism wherein the swing arm can be pivoted between a stowed position against the side of the boat with the seat out of the water to a deployed position below the waterline where a person can sit on the seat submerged to at least their waist in water and place an object on or take an object off or place an object on the bar top when the bar top is in the deployed flat position.

In yet another variation of the invention it is a method for providing a deployable stowable beverage bar for a pleasure craft that includes the steps of: a) providing a strapping mechanism that can be detachably but securely attached to the side of a boat; b) providing contact pivot points on the strapping mechanism to connect a bar top that can be pivoted between a folded stowed position against the boat to a deployed flat position above the waterline adjacent to the boat; and c) providing at least one seat attached to a first end of a swing arm, the second end of the swing arm being pivotally attached to the strapping mechanism where the swing arm can be pivoted between a stowed position against the side of the boat with the seat out of the water to a deployed position below the waterline where a person can sit on the seat submerged to at least their waist in water and place an object on or take an object off the bar when the bar is in the flat position.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 1:
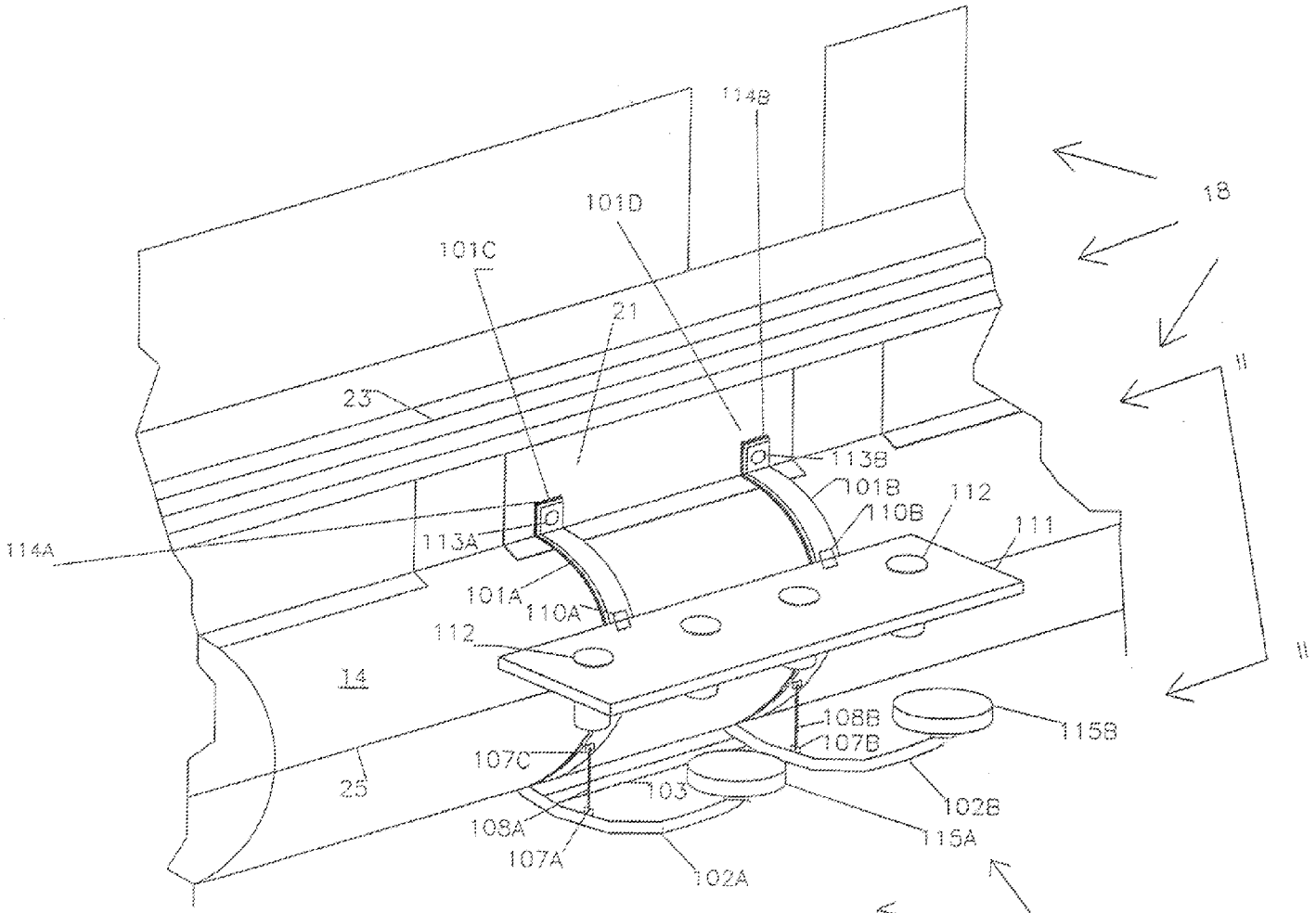
FIG. 1 is a perspective view of an embodiment of the present invention attached to a pontoon boat in deployed position.

The present invention is a detachable stowable bar for a pleasure craft, specifically a pontoon boat, also known as a party barge. FIG. 1 is a perspective view of an embodiment of the present invention of the detachable boat bar 11 attached to a pontoon 14 of a pontoon boat 18. In the embodiment of the invention depicted in FIG. 1 two curved rigid metal bands 101A and 101B that have a radius of curvature equivalent to pontoon 14 are positioned against pontoon 14. Bands 101A and 101B connect to strut 21 at their upper straight portions 101C and 101D by bolts 113A and 113B respectively. In a preferred embodiment the upper straight at portions are 4 inches long. Strut 21 connects pontoon 14 to boat deck-superstructure 23. Between rigid bands 101A and 101B and pontoon 14 are strips 114A and 114B of a flexible pliable material to provide a cushioning effect and protect the pontoon from damage by the rigid bands. In the preferred embodiment rubber or a similar resilient and pliable material would make up the strips 114A and 114B.

Bar 111 is attached by hinges 110A and 110B to metal bands 101A and 101B respectively and appears in its down and deployed position in FIG. 1. Two seats 115A and 115B attach by swing arms 102A and 102B to straps 101A and 101B, not shown in FIG. 1, but will be described below and illustrated in FIG. 2. Referring back to FIG. 1 the end of swing arm 102A attaches to seat 115A at projection 107A. Similarly swing arm 102B attaches to seat 115B in the same manner, at 107B. In the preferred embodiment this connection is a welded one so that the seat is rigidly fixed in place for someone to sit on it. Swing arms 1024 and 102B have a spreader 103 connecting them together. In the preferred embodiment spreader 103 is a ¾" SCH40 pipe. Spreader 103 maintains the distance between swing arm 102A and 102B so that the distance between seats 115A and 115B is maintained and two people can comfortably sit on the seats. As a further assurance of the stability and positioning of the swing arms 102A and 102B two braces 104A and 104B connect to swing arms 102A and 102B which will be discussed in more detail below.

Chain 108A and 108B connect the two bands 101A and 101B and swing arms 102A and 102B respectively. Chains 108A and 108B provide support and position seats 115A and 115B when the seats are deployed in the down position so people can comfortably sit on the seats. In the preferred embodiment chains 108A and 108B are 250 pound rated seamless link galvanized chain of a length that matches the diameter of the boat's pontoon. In a preferred embodiment chains 108A and 108B connect to swing arm 102A and 102B by half rounded weldable steel eyes 107A and 107B. Chain 108A connects to strap 101B by a steel plate 107C welded to strap 101. In a preferred embodiment plate 107C is a 3⁄16 inch steel plate with an 11⁄32 inch hold drilled in it for chain attachment. Plate 107C provides support for bar top 111 when it is in the down and deployed position. Chain 108B connects by a metal plate identical to plate 107C, which plate attaches to band 101B, not visible in FIG. 1. This plate also provides support for bar top 111 when it is in the down and deployed position. Bar top 111 has four cup holders 112.

Swing arms 102A and 102B are straight for half their length from their connection to seats 115A and 115B respectively to the middle of each swing arm. For the other half of their length, swing arms 102A and 102B, have a radius of curvature equivalent to the radius of curvature of the boat's pontoon from their center point to the point they connect to straps 101A and 101B, not shown in FIG. 1, but described and illustrated in FIG. 2.

As can be seen in FIG. 1, in the preferred embodiment stowable bar apparatus 11 is configured such that when it is attached to pontoon 14 of boat 18 and in the water the waterline 25 is just below the top of bar 111 but above seats 115A and 115B. This allows two people to comfortably sit at the bar in the water with water up to their waist or higher and still be able to place the cup on bar top 111 which is positioned in the preferred embodiment just above water line 25.

Figure 2:
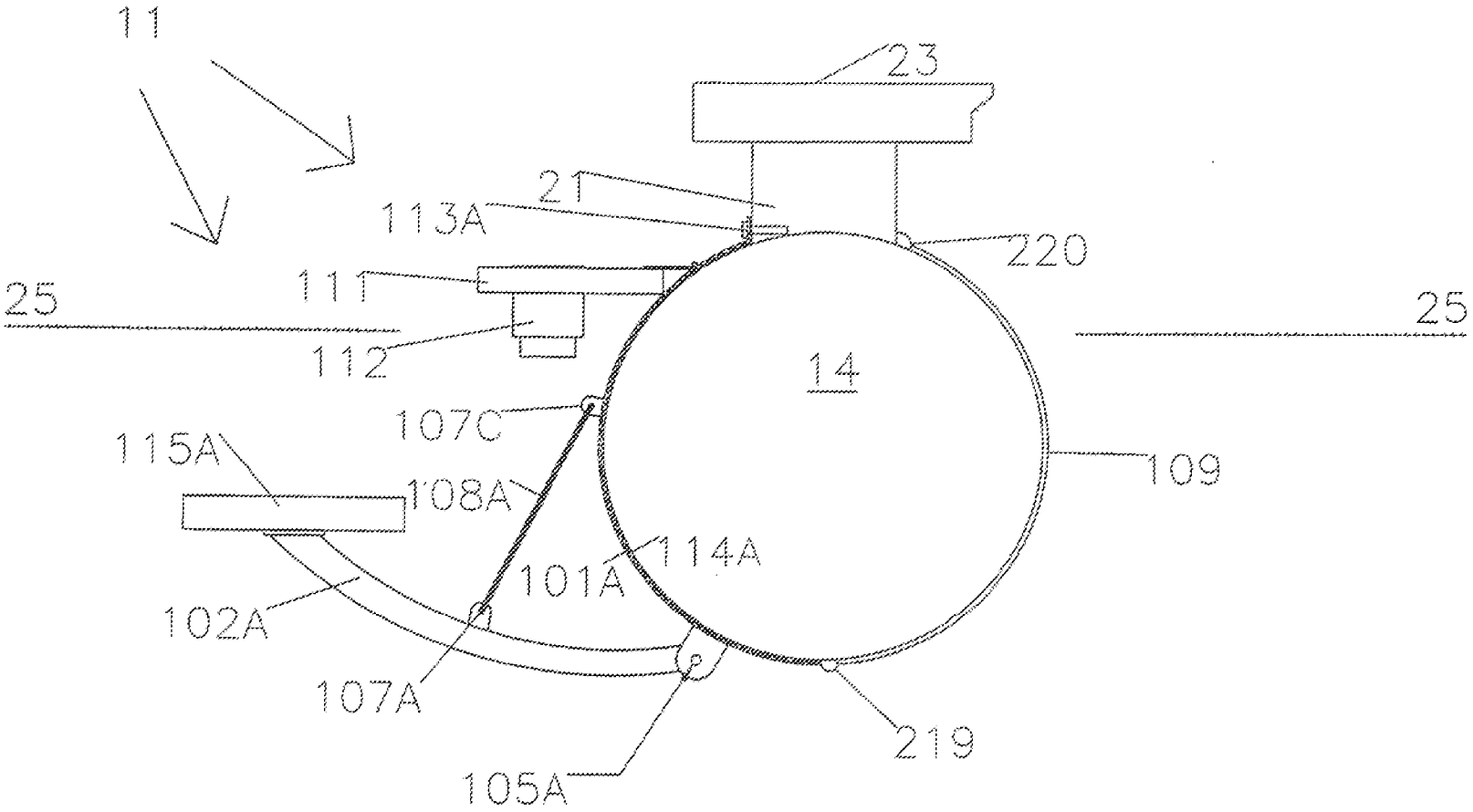
FIG. 2 is a cross-sectional view of the present invention attached to a pontoon of a pontoon boat along line II-II of FIG. 1.

FIG. 2 is a cross-sectional view along line II-II of FIG. 1 of the deployed stowable-detachable boat bar system 11 attached to pontoon 14. Band 101A in the preferred embodiment has a length equal to or slightly longer than half the diameter of pontoon 14 as depicted in FIG. 2. As noted above at its first end band 101A is secured to strut 21 by bolt 113A. As depicted in FIG. 2 band 101A is secured at its other end to an end 219 of flexible strap 109, in turn flexible strap 109 is secured at its second end 220 to strut 21. The connection at point 220 is by a hook on the end of strap 109 that hooks into an aperture on strut 21. However those skilled in the art once they review and understand the concepts of the invention will know there are other ways to make a secure but detachable connection of the end 220 of strap 109 to strut 21.

In one preferred embodiment strap 109 is made of nylon or similar resilient and durable fabric and has a ratchet device located at point 219 to secure both band 101A and strap 109A tightly but detachably against pontoon 14. Naturally, the ratcheting mechanism allows for the tightening or loosening of the combination band 101A and strap 109. Alternatively in another preferred embodiment strap 109 could be a stainless steel cable of perhaps 3⁄32" in diameter and of a length that would fit snuggly to pontoon 14 when attached to strut 21 and band 101A at either end. A turn type of buckle attachment connected to band 109 at point 219 or alternatively at connection 220 where it attaches to band 101 could be used to create the appropriate tension on band 101A and cable 109 to thereby detachably securethem to pontoon 14.

Swing arm 102A attaches to hinge 105A. Hinge 105A being attached to band 101A. The end of swing arm 102A attached to hinge 105 A is connected in a pivotal fashion such that arm 102A is allowed to swing up against pontoon 114, after bar counter 111 is pivoted up on hinges 110A and B as will be discussed and illustrated below.

Swing arm 102A when pivoted to the fully deployed position as depicted in FIG. 2 is held in place by chain 108A. Naturally, the connection of swing arm 102B to band 101B, not shown, is exactly the same as swing arm 102A it attaches at a pivot point at the end opposite seat 115B by a hinge that is the mirror image of hinge 105A and it also attaches by chain 108B the same as chain 108A attaches to swing arm 101A. In the preferred embodiment depicted in FIG. 2 detachable bar apparatus 11 is configured such that bar top or counter 111 is positioned just above waterline 25 when the boat is in the water. Likewise seats 115 A and B are positioned below the waterline when deployed such that when an individual sits on a seat the water comes up to his or her waist or higher. Also plate 107C is positioned such that when bar top 111 is in the down or deployed position it provides support for bar 111. Also, as noted elsewhere herein chain 108B attaches to band 101B by plate that is the mirror image of plate 107C and in the same position on band 101B as plate 107C is on band 101A so it also provides support for bar top 111 when in the down position or as depicted in FIG. 2. Naturally these aspects can be varied without departing from the concepts of the invention.

Figure 3:
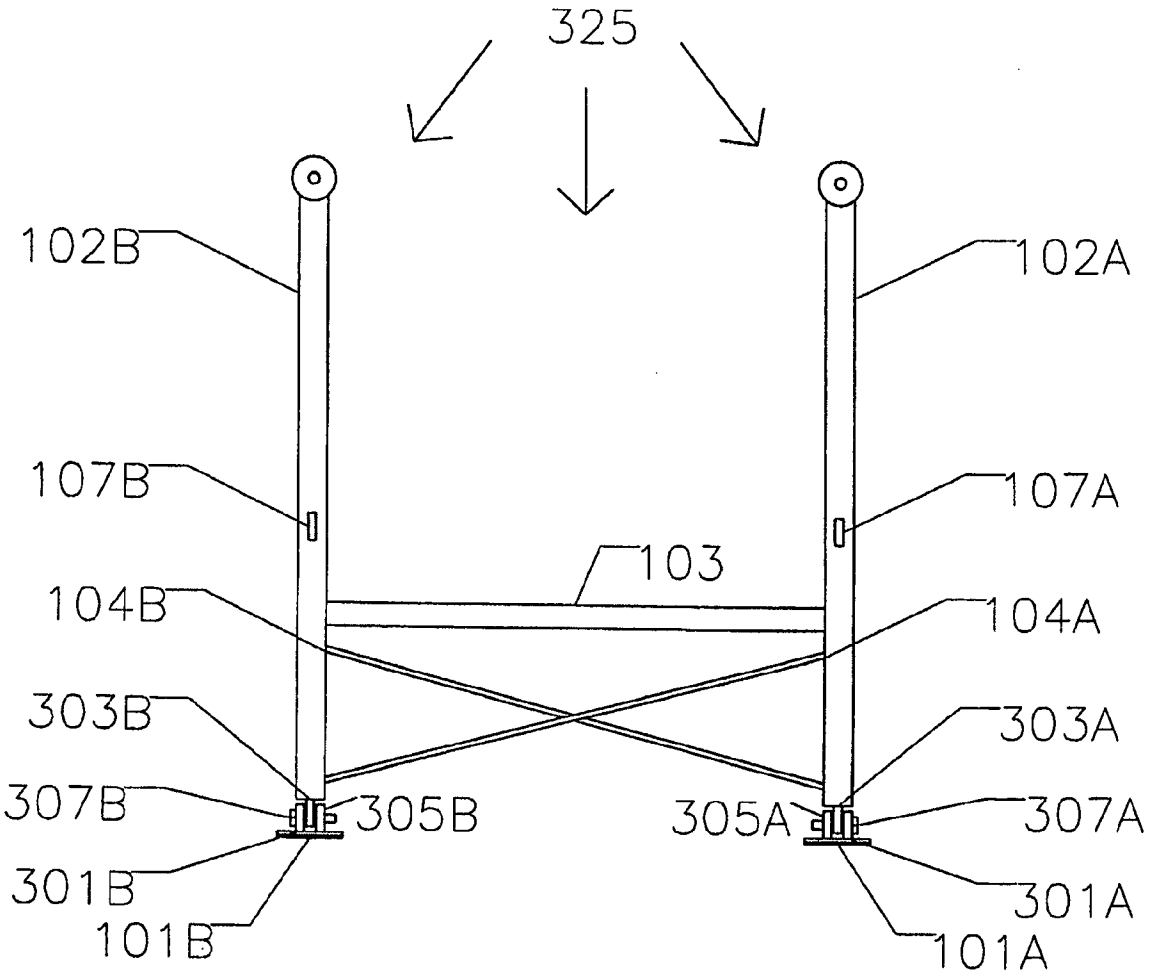
FIG. 3 is a top view of a swing arm assembly of an embodiment of the present invention.

FIG. 3 provides a top view of the complete swing arm structure 325 a portion of which can be seen in FIG. 1; however most of the bracing which maintains the correct orientation between swing arms 102A and 102B are positioned out of sight under pontoon 14 in FIG. 1. As can be seen in FIG. 3 spreader 103 which is securely attached at either end of swing arm 102A and 102B provides for the appropriate separation between the swing arms. Also, the lower connection for chain 108B connector 107B, in the preferred embodiment a half rounded steel eyelet, is depicted.

As noted in the preferred embodiment spreader 103 is welded to swing arms 102A and 102B. Additionally, braces 104A and 104B are securely connected to swing arms 102A and 102B and each other in the positions where they touch as depicted in FIG. 3. In the preferred embodiment the connections between braces 104A and 104B and swing arms 102A and 102B are welds. The combination of spreader 103, braces 104A and 104B as connected to swing arms 102A and 102B make the combination a solid unit that can pivot at hinges 105A and 105B.

A preferred embodiment of hinge 105A depicted in FIG. 3 consists of two hinge plates 301A and 303A which are attached to band 102A [shown in cross-section]. Hinge plates 301A and 303A are positioned such that a third hinge plate 305A attached to the lower end of swing arm 102A fits in between hinge plates 301A and 303A and thus the three plates can be detachably but securely connected by bolt 307A. This thus forms hinge 105A.

The same type of structure forms hinge 105B with hinge plates 301B and 303B attached to band 101B and hinge 305B attached to the lower end of swing arm 102B. This allows swing arm structure 325 to be pivoted at hinges 105A and 105B and thus allows for the deployment of the seats for use as depicted in FIGS. 1 and 2 or to stow the bar assembly 3 out of the water for movement of the boat as will be illustrated in FIG. 4.

Figure 4:
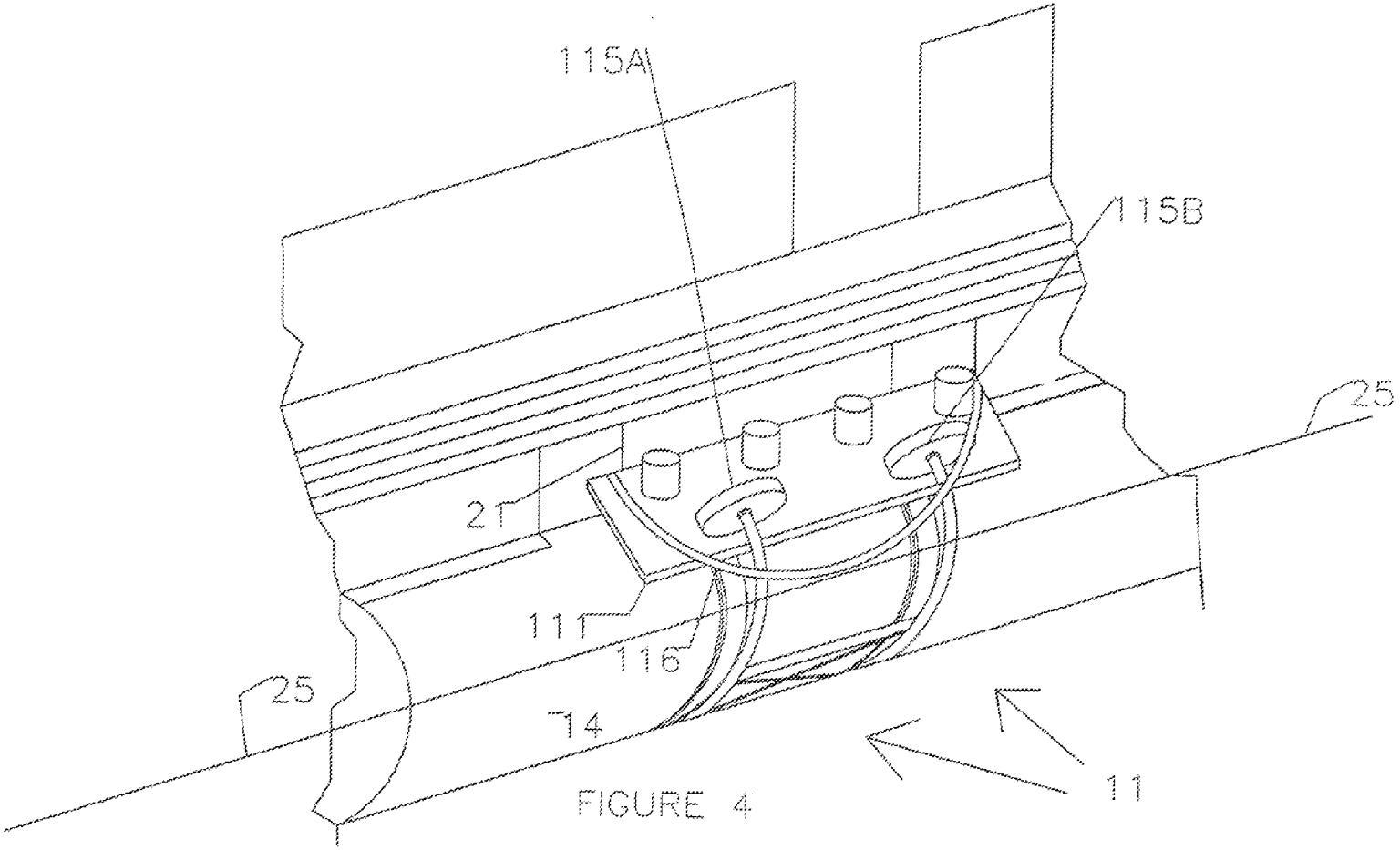
FIG. 4 is a perspective view of an embodiment of the present invention attached to a pontoon boat in a stowed position.

FIG. 4 provides a view of the bar assembly-apparatus 11 with the bar counter or top 111 swung up at a folding position and the swing arm assembly 325 also secured in the up and stowed position and held in place by restraining strap 116. Thus in this position the large parts of the bar structure assembly 11 including the bar 111 as well as seats 115 A and B and swing arm assembly 325 are above the waterline 25. This allows the pleasure craft to move to a different position on the body of water it may be located on without the excessive drag of the bar when it's in the deployed position. As also will be appreciated by those skilled in the art now that the details of the invention have been disclosed the whole structure can be very easily removed from the boat if there is a need such as when it may be moved on a trailer or for some other reason.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

I claim:

1. A deployable bar for a pontoon boat comprising:

a. at least two rigid bands each band having at a first end a short flat piece that connects to an extended curved portion that has a radius of curvature of a boat floatation pontoon and length equivalent to approximately half the diameter of the boat floatation pontoon;

b. flexible bands attached to a second end of each of said rigid bands, said flexible bands have a length that when added to the length of said curved portion of said rigid band is less than the diameter of the pontoon but of a sufficient length that when said flat short first ends of said at least two bands are attached to a support strut that connects a pontoon boat body to the floatation pontoon on the side of the boat a second end of said flexible bands attaches to an opposite side of the support strut to securely hold said rigid band against the pontoon;

c. said at least two rigid bands have hingedly connected to them a first end of a support frame, said support frame having at least one seat at a second end such that when said rigid bands and flexible bands are secured around the pontoon to the support strut connected to the pontoon, said support frame can be moved between an open position wherein when the pontoon boat is in the water a person can sit on said at least one seat partially submerged in the water next to the pontoon boat and said support frame can be moved to a stowed position wherein said at least one seat is positioned out of the water adjacent to a side of the boat; and d. a bar top hingedly attached to said rigid bands such that it can be moved from an open position where someone sitting in said at least one seat when said support frame is in an open position can place an item on the bar top to a stowed position where it is up out of the water next to the side of the boat.

2. The deployable bar of claim 1 wherein said flexible bands are selected from a group consisting of nylon straps and stainless steel cable.

3. The deployable bar of claim 1 further comprising flexible cushioning strips positioned between each of said at least two rigid bands and the boat floatation pontoon.

4. The deployable bar of claim 1 further comprising a tensioning mechanism connected to each of said flexible straps said tensioning mechanism being selected from a group of a ratchet mechanism or turn buckles.

5. The deployable bar of claim 1 wherein said support frame is positioned in said open down position by flexible bands of appropriate length that attach at a first end to said rigid bands and at a second end to said support frame.

6. The deployable bar of claim 5 wherein said flexible bands are selected from a group of flexible straps or chains.

7. The deployable bar of claim 1 wherein said bar top has at least one cup holder.

8. The deployable bar of claim 1 wherein said at least one seat is a plurality of seats.

9. The deployable bar of claim 1 wherein said at least two rigid bands is a plurality of bands.

10. A deployable stowable beverage bar for a pleasure craft comprising:

a. a strapping mechanism that can be detachably but securely attached to the side of a boat wherein said strapping mechanism comprises:

i. at least two rigid bands each band having at a first end a short flat piece that connects to an extended curved portion that has a radius of curvature of a boat floatation pontoon and length equivalent to approximately half the diameter of the boat floatation pontoon;

ii. flexible bands attached to a second end of each of said rigid bands, said flexible bands have a length that when added to the length of said curved portion of said at least two rigid bands are less than the diameter of the pontoon but of a sufficient length that when said flat short first ends of said at least two bands are attached to a support strut that connects a pontoon boat body to the floatation pontoon on the side of the boat a second end of said flexible band attaches to an opposite side of the support strut to securely hold said rigid band against the pontoon;

b. contact pivot points on said strapping mechanism to connect a bar top that can be pivoted between a folded stowed position against the boat to a deployed flat position above the waterline adjacent to the boat, wherein said contact pivot points are positioned on each of said at least two rigid bands and wherein said swing arm is pivotally attached to said at least two bands; and c. at least one seat attached to a first end of a swing arm, the second end of said swing arm being pivotally attached to said strapping mechanism wherein said swing arm can be pivoted between a stowed position against the side of the boat with said seat out of the water to a deployed position below the waterline where a person can sit on said seat submerged to at least their waist in water and place an object on or take an object off said bar top when said bar top is in said deployed flat position.

11. The deployable bar of claim 10 wherein said flexible bands are selected from a group consisting of nylon straps or stainless steel cable.

12. The deployable bar of claim 10 further comprising flexible cushioning strips positioned between each of said at least two rigid bands and the boat floatation pontoon.

13. The deployable bar of claim 10 further comprising a tensioning mechanism connected to each of said at least two flexible straps said tensioning mechanism being selected from a group consisting of a ratchet mechanism and turn buckles.

14. The deployable bar of claim 10 wherein said swing arm is positioned in said open down position by flexible bands of appropriate length that attach at a first end to said rigid bands and at a second end to said swing arm.

15. The deployable bar of claim 10 wherein said bar top has at least one cup holder.

16. The deployable bar of claim 10 wherein that at least one seat is a plurality of seats.

17. The deployable bar of claim 10 wherein said at least two rigid bands is a plurality of rigid bands.

18. A method for providing a deployable stowable beverage bar for a pleasure craft comprising steps of:

1. Providing a strapping mechanism that can be detachably but securely attached to the side of a boat wherein said strapping mechanism comprising:

a. at least two rigid bands each band having at a first end a short flat piece that connects to an extended curved portion that has a radius of curvature of a boat floatation pontoon and length equivalent to approximately half the diameter of the boat floatation pontoon;

b. flexible bands attached to a second end of each of said rigid bands, said flexible bands have a length that when added to the length of said curved portion of said at least two rigid bands are less than the diameter of the pontoon but of a sufficient length that when said flat short first ends of said at least two bands are attached to a support strut that connects a pontoon boat body to the floatation pontoon on the side of the boat a second end of said flexible band attaches to an opposite side of the support strut to securely hold said rigid band against the pontoon;

2. Providing contact pivot points on the strapping mechanism to connect a bar top that can be pivoted between a folded stowed position against the boat to a deployed flat position above the waterline adjacent to the boat, wherein said contact pivot points are positioned on each of said at least two rigid bands and wherein said swing arm is pivotally attached to said at least two bands;

3. Providing at least one seat attached to a first end of a swing arm, the second end of the swing arm being pivotally attached to the strapping mechanism where the swing arm can be pivoted between a stowed position against the side of the boat with the seat out of the water to a deployed position below the waterline where a person can sit on the seat submerged to at least their waist in water and place an object on or take an object off the bar when the bar is in the flat position.

19. The method of claim 18 wherein the step of providing at least one seat further comprises the step of providing a plurality of seats.

* * * * *